US009353925B2

(12) United States Patent
Okawa et al.

(10) Patent No.: US 9,353,925 B2
(45) Date of Patent: May 31, 2016

(54) VEHICULAR LAMP WITH OPTICAL MEMBER HAVING THERMAL STRESS ABSORPTION FEATURES

(71) Applicant: KOITO MANUFACTURING CO., LTD., Tokyo (JP)

(72) Inventors: Masao Okawa, Shizuoka (JP); Ryuho Sato, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 50 days.

(21) Appl. No.: 14/060,036

(22) Filed: Oct. 22, 2013

(65) Prior Publication Data

US 2014/0112013 A1 Apr. 24, 2014

(30) Foreign Application Priority Data

Oct. 22, 2012 (JP) ..... 2012-233200
Jun. 27, 2013 (JP) ..... 2013-134987

(51) Int. Cl.
*F21S 8/10* (2006.01)
*F21V 7/10* (2006.01)
*F21V 13/02* (2006.01)

(52) U.S. Cl.
CPC ..... *F21S 48/1305* (2013.01); *F21S 48/1394* (2013.01); *F21S 48/142* (2013.01); *F21V 7/10* (2013.01); *F21V 13/02* (2013.01)

(58) Field of Classification Search
CPC ..... F21V 15/012; F21V 7/10; F21V 15/00; F21V 29/00; F21V 17/10–17/22; B60Q 1/0005; B60Q 1/0491; B60Q 2200/34
USPC ..... 362/369, 390, 430, 449, 539, 341
See application file for complete search history.

(56) References Cited

U.S. PATENT DOCUMENTS

| | | | | |
|---|---|---|---|---|
| 4,066,887 | A * | 1/1978 | Levis | 362/341 |
| 5,446,638 | A * | 8/1995 | Matsuzaki et al. | 362/341 |
| 5,904,416 | A * | 5/1999 | Muller | 362/288 |
| 6,170,970 | B1 * | 1/2001 | Eto | 362/539 |
| 6,238,072 | B1 * | 5/2001 | Eto | 362/539 |
| 6,575,603 | B2 * | 6/2003 | Stahl et al. | 362/346 |
| 6,657,369 | B1 * | 12/2003 | Tamaru et al. | 313/318.11 |
| 7,008,098 | B2 * | 3/2006 | Yamaguchi et al. | 362/547 |
| 2001/0015897 | A1 * | 8/2001 | Aida et al. | 362/519 |

(Continued)

FOREIGN PATENT DOCUMENTS

| | | | |
|---|---|---|---|
| CN | 101592323 | A | 12/2009 |
| CN | 101936493 | A | 1/2011 |

(Continued)

OTHER PUBLICATIONS

Office Action issued in corresponding Chinese Application No. 201310499250.X, mailed Sep. 17, 2014 (16 pages).

(Continued)

*Primary Examiner* — Jong-Suk (James) Lee
*Assistant Examiner* — Colin Cattanach
(74) *Attorney, Agent, or Firm* — Osha Liang LLP

(57) ABSTRACT

An optical member formed of resin includes a fixation portion, via which the optical member is fixed to a supporting member on which a light emitting element is supported, a reflective surface having a reflective region configured to reflect light from the light emitting element, and a thermal deformation absorbing portion configured to absorb thermal deformation of the optical member.

8 Claims, 8 Drawing Sheets

(56) References Cited

U.S. PATENT DOCUMENTS

| | | | | |
|---|---|---|---|---|
| 2002/0071280 | A1* | 6/2002 | Stahl et al. | 362/346 |
| 2005/0122736 | A1 | 6/2005 | Watanabe et al. | |
| 2010/0321947 | A1* | 12/2010 | Hamashima | 362/517 |

FOREIGN PATENT DOCUMENTS

| | | | | |
|---|---|---|---|---|
| EP | 0 582 994 | A2 | 2/1994 | |
| EP | 0 717 233 | A | 6/1996 | |
| EP | 1 884 708 | A1 | 2/2008 | |
| JP | 04368702 | A * | 12/1992 | F21M 3/05 |
| JP | 2000322913 | A | 11/2000 | |
| JP | 2005209604 | A | 8/2005 | |

OTHER PUBLICATIONS

Extended European Search Report in counterpart European Application No. EP 13 189 605.2 issued Jan. 30, 2014 (7 pages).

* cited by examiner

VEHICULAR LAMP WITH OPTICAL MEMBER HAVING THERMAL STRESS ABSORPTION FEATURES

CROSS-REFERENCE TO RELATED APPLICATION(S)

The present application claims the benefit of priorities of Japanese Patent Application No. 2012-233200 filed on Oct. 22, 2012 and Japanese Patent Application No. 2013-134987 filed on Jun. 27, 2013. The disclosures of the applications are incorporated herein by reference.

BACKGROUND

Technical Field

The present disclosure relates to an optical member and a vehicular lamp, which prevent the deformation of a light distribution pattern due to the fact that the optical member is thermally deformed by a lighting heat of a light emitting element.

Patent Document 1 discloses a projector type vehicular lamp for forming a light distribution pattern on the front of a vehicle in such a way that the light emitted from an LED that is a light source is reflected by a reflector. In the projector type vehicular lamp disclosed in Patent Document 1, the LED fixed to an attachment plate is disposed so that the LED is screwed to an upper reflector having a small concave mirror (reflective surface) of a spheroidal curved surface shape and therefore the LED is surrounded with the small concave mirror of the upper reflector. The upper reflector having the LED fixed thereto constitutes a small reflector together with a lower reflector in such a way that a flange portion thereof is screwed to the lower reflector. The small reflector is fixed to a casing by being screwed to an attachment tool (supporting member), as described in paragraph [0045] and FIG. 3 and FIG. 4 of Patent Document 1.

Patent Document 1: Japanese Patent Laid-Open Publication No. 2005-209604

Since the upper reflector of the projector type vehicular lamp disclosed in Patent Document 1 is formed of resin and connected to the LED via the attachment plate, the upper reflector is thermally expanded by receiving heat from the LED during lighting. The thermal expansion of the upper reflector becomes greater as the size of the small reflector is reduced with the miniaturization of the projector type vehicular lamp. The thermal expansion of the small reflector having received heat is restricted in a lateral direction when flange portions formed integrally to the left and right thereof are fixed to an attachment portion. As a result, the small reflector having received heat is thermally expanded toward the upper side that is not fixed, together with the small concave mirror (reflective surface) and therefore the small concave mirror is thermally deformed to an unexpected shape. The thermal deformation of the small concave minor causes the deformation of a light distribution pattern.

SUMMARY

Exemplary embodiments of the invention provide an optical member and a vehicular lamp, in which the deformation of a light distribution pattern is difficult to occur, even when the optical member such as a reflector or shade is thermally deformed by heat generated at the time of lighting of a light emitting element.

An optical member formed of resin, according to an exemplary embodiment of the invention, comprises a fixation portion, via which the optical member is fixed to a supporting member on which a light emitting element is supported;

a reflective surface having a reflective region configured to reflect light from the light emitting element; and a thermal deformation absorbing portion configured to absorb thermal deformation of the optical member.

(Effect)

The thermal deformation absorbing portion absorbs the thermal deformation of the optical member at the time of lighting of the light emitting element. Therefore, it is likely that the optical member will be able to be thermally deformed while keeping a similar shape to the reflective region. As a result, the light distribution pattern is likely to have a similar shape to a desired light distribution pattern.

The thermal deformation absorbing portion may be formed at a portion other than the reflective region.

(Effect)

Since the thermal deformation absorbing portion is less likely to hinder the reflection of light to be incident on the reflective region, the desired light distribution pattern shape can be easily obtained.

The optical member may further comprise:

a reflector body including the reflective surface, and an arm part formed to extend from the reflector body, wherein the fixation portion and the thermal deformation absorbing portion are provided in the arm part.

The reflector body having the reflective region is fixed to the supporting member by the fixation portion of the arm part extending from the reflector body.

(Effect)

Owing to the thermal deformation absorbing portion, the arm part fixed to the supporting member via the fixation portion is deformed so as not to hinder the free thermal deformation of the reflector body. As a result, the reflector body is thermally deformed while keeping a similar shape thereto and therefore the light distribution pattern is more likely to have a similar shape to the desired light distribution pattern.

The thermal deformation absorbing portion may be provided between the reflective region and the fixation portion.

(Effect)

The optical member having received the heat generated at the time of lighting of a light emitting element (hereinafter referred as a lighting heat of the light emitting element) tends to be thermally deformed toward the fixation portion, together with the reflective region. However, since the optical member and the reflective region are thermally deformed while keeping the similar shape thereto, owing to the thermal deformation absorbing portion provided between the fixation portion and the reflective region, the light distribution pattern having a similar shape to the desired light distribution pattern is likely to be formed.

The thermal deformation absorbing portion may be a gap portion.

(Effect)

The thermal deformation absorbing portion that is a gap portion is thermally deformed together with the reflective region while keeping the similar shape thereto in such a way that the gap portion is narrowed by the thermal expansion of the optical member. As a result, the light distribution pattern having a similar shape to the desired light distribution pattern is likely to be formed.

The thermal deformation absorbing portion may be a wave-shaped portion.

(Effect)

The wave-shaped portion absorbs the thermal deformation of the optical member by being expanded/contracted due to the thermal deformation of the optical member and therefore both the optical member and the reflective region are deformed in a state of keeping a bilaterally symmetric shape thereof. Accordingly, the light distribution pattern having a similar shape to the desired light distribution pattern is likely to be formed.

The optical member may further comprise:

a shade arranged near a focal point that is focused forward by a light reflected from the reflective region and configured to shield a portion of the reflected light.

(Effect)

The optical member including the shade is thermally deformed while keeping a similar shape thereto, owing to the thermal deformation absorbing portion. As a result, the relative position of the cutoff line to be formed by the shade is not lowered and therefore the light distribution pattern having a similar shape to the desired light distribution pattern is likely to be formed.

The shade may include a thermal deformation absorbing portion different from the thermal deformation absorbing portion of the arm part.

(Effect)

Since the thermal deformation of the shade is absorbed by the thermal deformation absorbing portion, the shade is likely to be deformed in a state of keeping a similar shape thereto. As a result, the relative position of the cutoff line to be formed by the shade is not lowered and therefore the light distribution pattern having a similar shape to the desired light distribution pattern is more likely to be formed.

The shade may includes a reflective region configured to reflect the light reflected from the reflective region of the reflector body, and in the shade, the thermal deformation absorbing portion is provided at a region other than the reflective region.

The optical member may further comprise:

a shade configured to shield a portion of the light from the light emitting element, the shade including the reflective surface and the thermal deformation absorbing portion, wherein the thermal deformation absorbing portion is provided at a region other than the reflective region.

(Effect)

Since the thermal deformation absorbing portion provided in the shade is less likely to hinder the reflection of light to be incident on the reflective region, the desired light distribution pattern can be easily obtained.

A vehicular lamp according to an exemplary embodiment of the invention comprises:

a light emitting element;

the optical member described above; and a supporting member on which the light emitting element and the optical member are supported, wherein the light emitting element, the optical member and the supporting member are provided in a lamp chamber formed by a front cover and a lamp body.

(Effect)

Since the optical member is likely to be thermally deformed while keeping a similar shape to the reflective region, the light distribution pattern to be formed in the vehicular lamp is likely to have a similar shape to the desired light distribution pattern.

According to the optical member and the vehicular lamp, the light distribution pattern having a similar shape to the desired light distribution pattern is likely to be formed even when the reflective region is deformed by the thermal deformation of the optical member. Accordingly, it is possible to obtain a light distribution pattern in which the deformation is reduced.

According to the optical member and the vehicular lamp, the light to be incident on the reflective region is reflected appropriately without being hindered by the thermal deformation absorbing portion. Accordingly, it is possible to obtain a light distribution pattern in which the deformation is further reduced.

According to the optical member and the vehicular lamp, the relative position of the cutoff line to be formed by the shade is not lowered and therefore it is possible to obtain a light distribution pattern in which the deformation is further reduced.

DETAILED DESCRIPTION

Figure 1A:
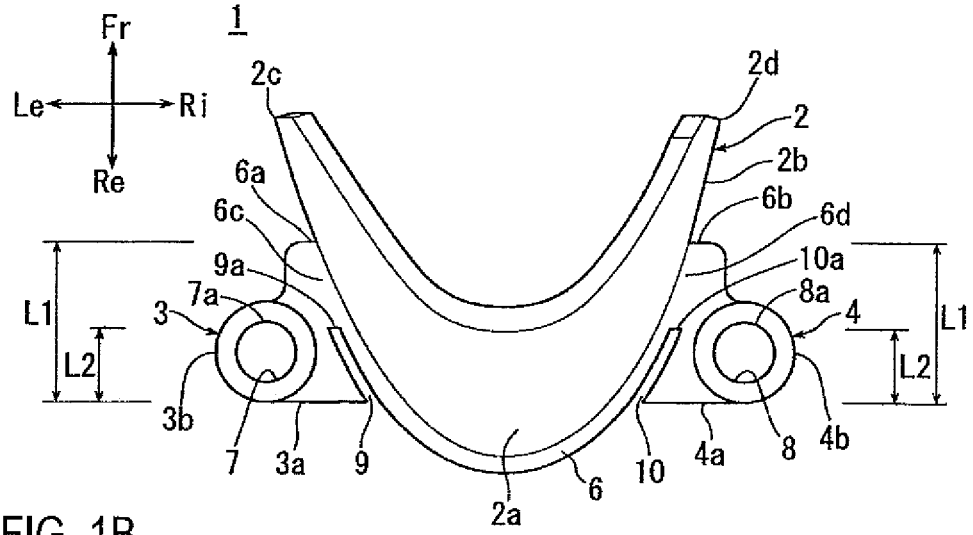
FIG. 1A is a plan view showing a reflector of a vehicular headlamp according to a first embodiment.
Figure 1B:
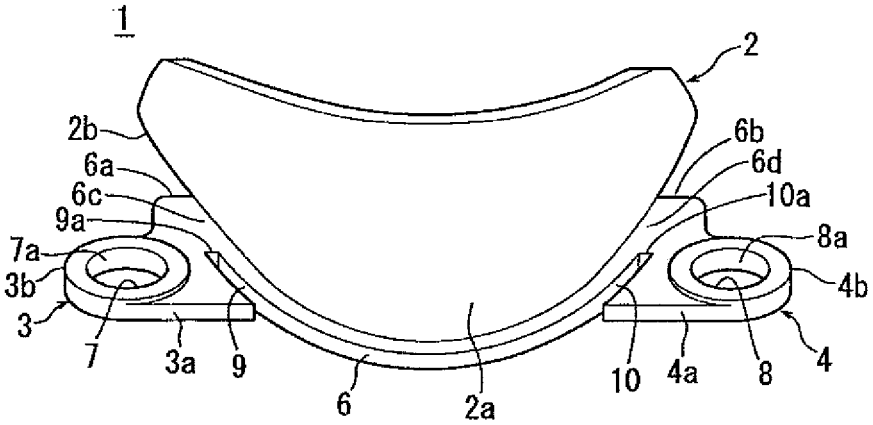
FIG. 1B is a perspective view of the reflector in the first embodiment, as seen obliquely from the rear upper side.
Figure 1C:
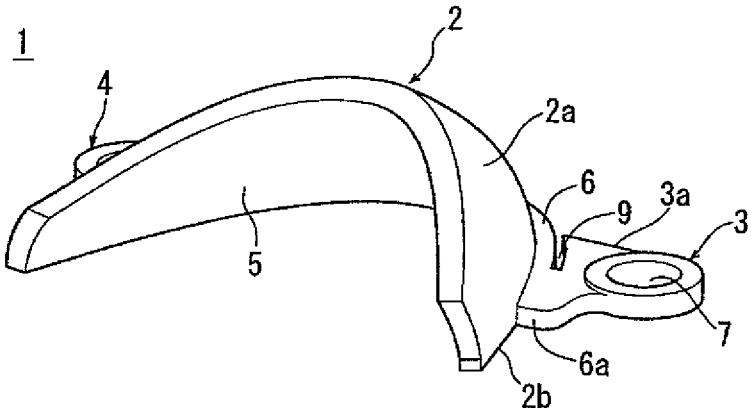
FIG. 1C is a perspective view of the reflector in the first embodiment, as seen obliquely from the left upper side.

A reflector of a vehicular headlamp according to a first embodiment will be described with reference to FIGS. 1A to 1C. The reflector is an optical member for reflecting and controlling the light emitted from an LED light source. The vehicular headlamp is one of a vehicular lamp that is a light emitting device for a vehicle. In FIG. 1A to FIG. 6, as shown in FIG. 1A, a direction of a reflective surface of a reflector body directly facing a lens and a rear direction of the reflective surface are referred to as "a front-rear direction (a direction of the reference numeral Fr and Re)", a formation direction of an arm part formed integrally with the reflector body is referred to as "a left-right direction (a direction of the reference numeral Le and Ri)" and an extending direction of a mounting hole of the arm part is referred to as "an up-down direction (a direction of the reference numeral Up and Lo)".

A reflector 1 according to the first embodiment includes a reflector body 2 made of resin and a pair of arm parts 3, 4 formed integrally with the reflector body 2. The resin reflector body 2 has a shape that is obtained by obliquely cutting a semi paraboloid of revolution forward from the rear. As a result, the reflector body 2 is opened to the front and has a substantially U shape, as seen from the upper surface. At an inner side of the reflector body 2, a reflective surface 5 configured by a portion of the paraboloid of revolution is formed by silver deposition or the like. Respective reflective surfaces 5, 26, 26' in the first embodiment and a second and third embodiment (to be described later) include a reflective region where light is incident and reflected and a region (where light is not incident) other than the reflective region.

The reflector body 2 is provided with a rib 6 protruding in a horizontal direction, along a lower end portion 2*b* of an outer peripheral surface 2*a* thereof. Left and right front end portions 6*a*, 6*b* of the rib 6 are respectively provided at positions spaced rearward from front end portions 2*c*, 2*d* of the reflector body 2. The pair of arm parts 3, 4 is integrally provided in the outer peripheral surface 2*a* of the reflector body 2 so as to extend laterally from the vicinity of the front end portions 6*a*, 6*b* of the rib 6. At left and right ends 3*b*, 4*b* of the pair of arm parts 3, 4, circular holes 7, 8 serving as a fixation portion for a supporting member (not shown) are provided at positions that are located in the vicinity of rear ends 3*a*, 4*a* and spaced laterally from the outer peripheral surface 2*a*. The circular holes 7, 8 are penetrated in a vertical direction.

The arm parts 3, 4 are respectively formed with gap portions 9, 10 serving as a thermal deformation absorbing portion (thermal expansion guiding portion). The gap portions 9, 10 are provided at boundary portions of the rib 6 and the arm parts 3, 4 in between the circular holes 7, 8. The reflector body or a shade (to be described later) is deformed by a lighting heat of a light emitting element. Thermal deformation such as thermal expansion occurring in the reflector body or the shade (to be described later) is absorbed by being guided by the thermal deformation absorbing portions. The gap portions 9, 10 are formed on the front along the lower end 2*b* of the reflector body 2 from the rear ends 3*a*, 4*a* of the arm parts. The gap portions 9, 10 are formed between the circular holes 7, 8 serving as a fixation portion and the reflective surface 5 including the reflective region.

The reflector 1 is fixed to a supporting member in such a way that screw members (not shown) inserted into the circular holes 7, 8 are screwed to a reflector fixing portion of the supporting member (not shown) of a vehicular headlamp.

The lateral clearances of the gap portions 9, 10 are narrowed when the reflector body 2 receives the heat of a light emitting element (not shown) from the supporting member and therefore is thermally defaulted (thermally expanded). Therefore, the reflector body 2 can be thermally deformed laterally toward the fixation portion for the supporting member, i.e., toward the circular holes 7, 8. The reflector body 2 is thermally deformed in a lateral direction owing to the gap portions 9, 10, instead of being thermally deformed only in a vertical direction. Accordingly, both the reflector body 2 and the reflective surface 5 on the inside thereof are thermally deformed while keeping a bilaterally symmetric shape thereof. As a result, the reflective surface 5 forms a light distribution pattern that has a similar shape to a desired light distribution pattern and therefore a deformation of a light distribution pattern is prevented.

The gap portions 9, 10 are preferably provided in the arm parts 3, 4 so that front end portions 9*a*, 10*a* thereof are substantially flush with or located in front of front end portions 7*a*, 8*a* of the circular holes 7, 8. In a case where the front end portions 9*a*, 10*a* of the gap portions 9, 10 are provided rearward of the front end portions 7*a*, 8*a* of the circular holes 7, 8 and therefore overlapped with the left and right regions of the circular holes 7, 8, there is a possibility that the reflector 1 is less likely to be thermally deformed laterally while keeping a similar shape thereto, in a portion of the arm parts 3, 4 located between the front end portions 7*a*, 8*a* of the circular holes 7, 8 and the outer peripheral surface 2*a*. In a case where the front end portions 9*a*, 10*a* of the gap portions 9, 10 are substantially flush with or located in front of the front end portions 7*a*, 8*a* of the circular holes 7, 8, the thermal deformation of the reflector body 2 in a lateral direction is less likely to be hindered and therefore a deformation of a light distribution pattern is further prevented.

Further, in order to maintain the strength of connecting regions 6*c*, 6*d* of the rib 6 and the arm parts 3, 4, the arm parts 3, 4 and the rib 6 are preferably formed so that a longitudinal length L1 from the rear end portions 3*a*, 4*a* to the front end portions 6*a*, 6*b* of the rib 6 is sufficiently longer than a longitudinal direction L2 from the rear end portions 3*a*, 4*a* to the front end portions 9*a*, 10*a* of the gap portions 9, 10. For example, it is preferable that L is twice as long or more than L2.

Figure 2A:
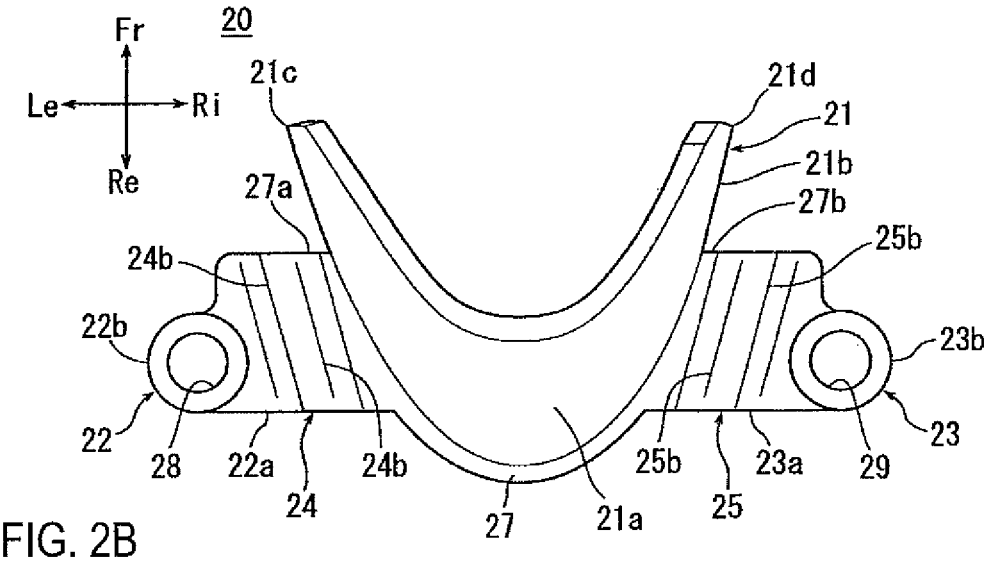
FIG. 2A is a plan view showing a reflector of a vehicular headlamp according to a second embodiment.
Figure 2B:
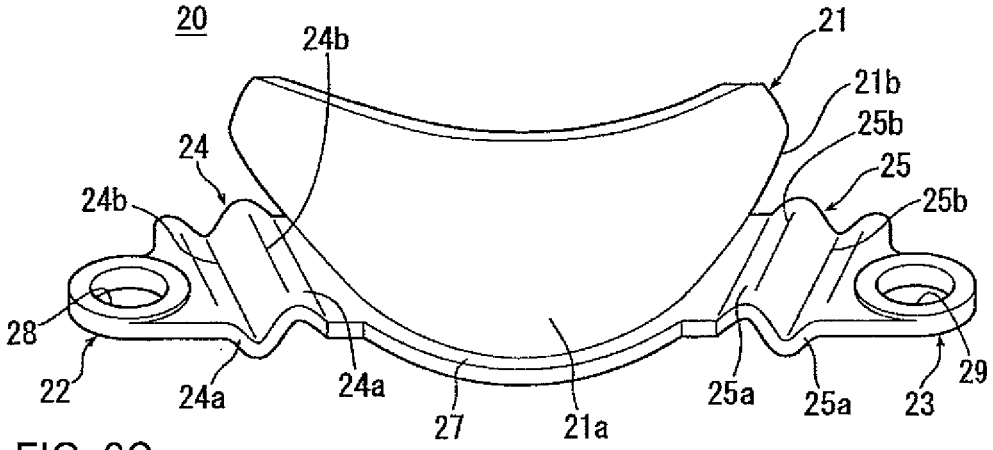
FIG. 2B is a perspective view of the reflector in the second embodiment, as seen obliquely from the rear upper side.
Figure 2C:
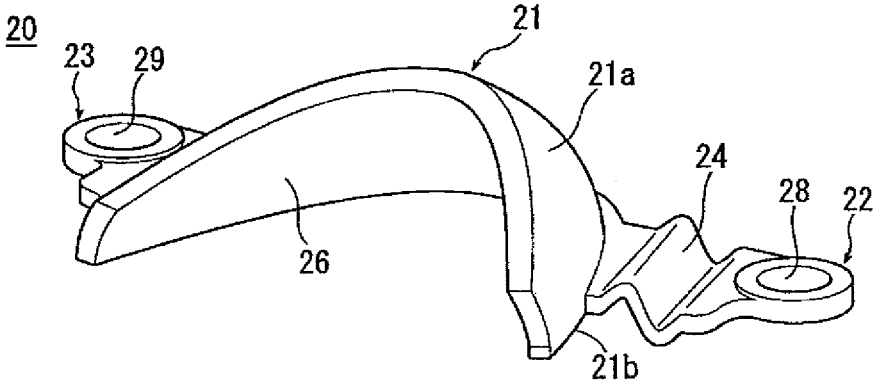
FIG. 2C is a perspective view of the reflector in the second embodiment, as seen obliquely from the left upper side.

Next, a reflector of a vehicular headlamp according to a second embodiment will be described with reference to FIGS. 2A to 2C.

In a reflector 20 of the second embodiment, a pair of left and right arm parts 22, 23 is provided with wave-shaped parts 24, 25 serving as a thermal deformation absorbing portion (thermal expansion guiding portion). The left and right arm parts 22, 23 are formed integrally with a reflector body 21 having the same shape as the reflector body 2 of the first embodiment, by a flexible resin (for example, resin such as Polycarbonate (PC), Polypropylene (PP), Polycarbonate-ABS (PC-ABS)). At an inner side of the reflector body 21, a reflective surface 26 configured by a portion of the paraboloid of revolution is formed by silver deposition or the like.

The reflector body 21 is provided with a rib 27 protruding in a horizontal direction, along a lower end portion 21*b* of an outer peripheral surface 21*a* thereof. Left and right front end portions 27*a*, 27*b* of the rib 27 are respectively provided at positions spaced rearward from front end portions 21*c*, 21*d* of the reflector body 21. The pair of arm parts 22, 23 is integrally provided in the outer peripheral surface 21 a of the reflector body 21 so as to extend laterally from the vicinity of the front end portions 27*a*, 27*b* of the rib 27. At left and right ends 22*b*, 23*b* of the pair of arm parts 22, 23, circular through-holes 28, 29 serving as a fixation portion for a supporting member (to be described later) are provided at positions that are located in the vicinity of rear ends 22*a*, 23*a* and spaced laterally from the outer peripheral surface 21*a*.

At the left and right arm parts 22, 23, the wave-shaped parts 24, 25 serving as a thermal deformation absorbing portion are provided between the circular holes 28, 29 and the rib 27, respectively. Each of the left and right wave-shaped parts 24, 25 has a bellows shape in which convex portions 24*a*, 25*a* are continued while facing upward and downward, alternately. Further, the convex portions 24*a*, 25*a* are bent at bent portions 24*b*, 25*b* so that the convex portions are gradually flared forward from the rear along the lower end portion 21 b of the outer peripheral surface 21*a*.

Figure 3:
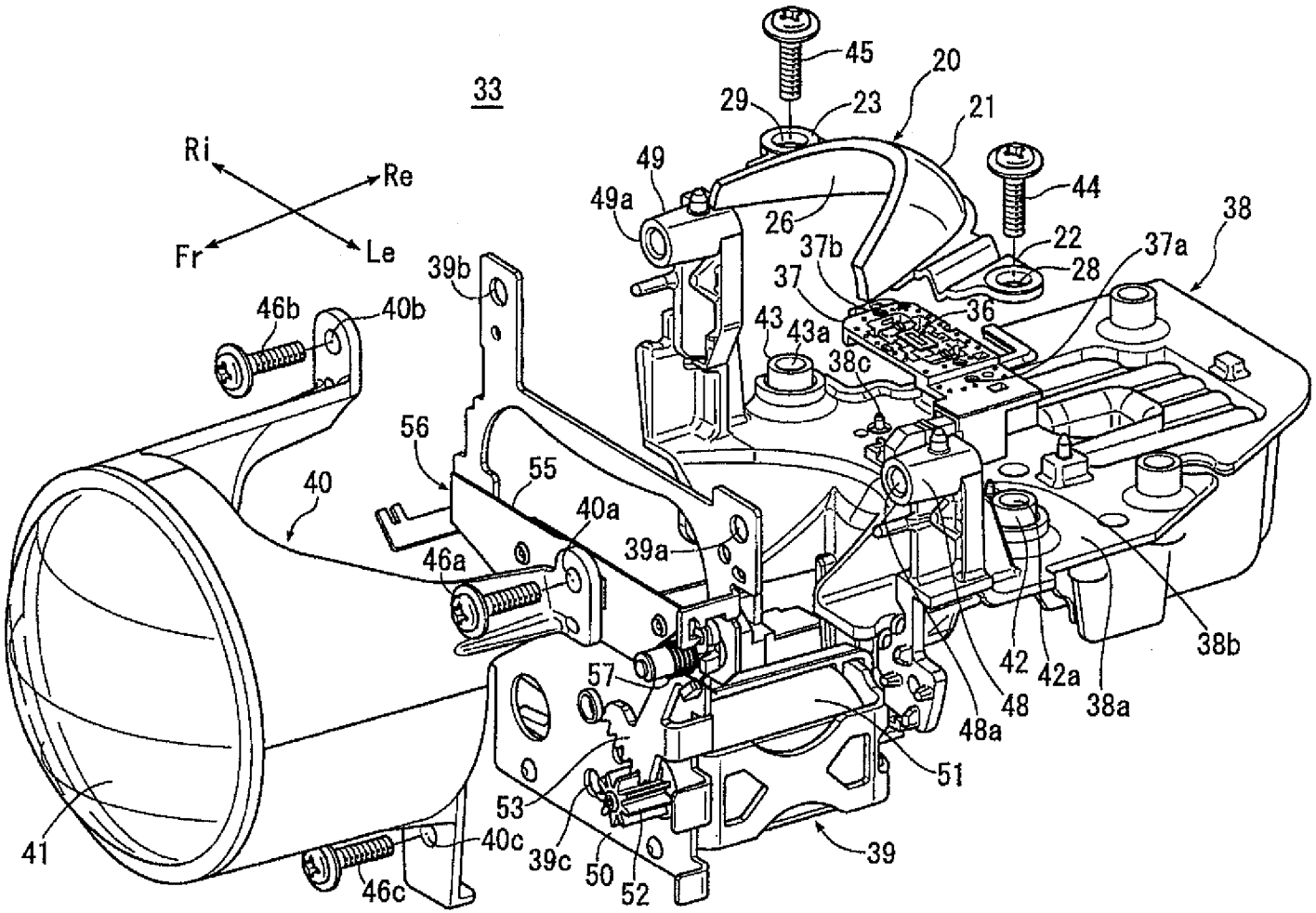
FIG. 3 is an exploded perspective view of a vehicular headlamp mounted with the reflector of the second embodiment.

As shown in FIG. 3, the reflector 20 is fixed to a supporting member 38 of a vehicular headlamp 33 (to be described later) by screw members 44, 45 inserted into the circular holes 28, 29. Heat generated from an LED (Light Emitting Element) 36 fixed to the supporting member 38 is transmitted to the reflector 20 via the supporting member 38. When the reflector body 21 is subjected to the heat generated from the LED, the reflector body 21 is thermally deformed laterally toward the circular holes 28, 29, owing to the contraction of the wave-shaped portions 24, 25 of the arm parts 22, 23. As a result, the thermal deformation of the reflector body 21 and the reflective surface 26 in a lateral direction is not hindered and therefore both the reflector body 21 and the reflective surface 26 on the inside thereof are thermally deformed while keeping a bilaterally symmetric shape thereof. Consequently, the reflective surface 26 forms a light distribution pattern that has a similar shape to a desired light distribution pattern and therefore a deformation of a light distribution pattern is prevented.

Figure 4:
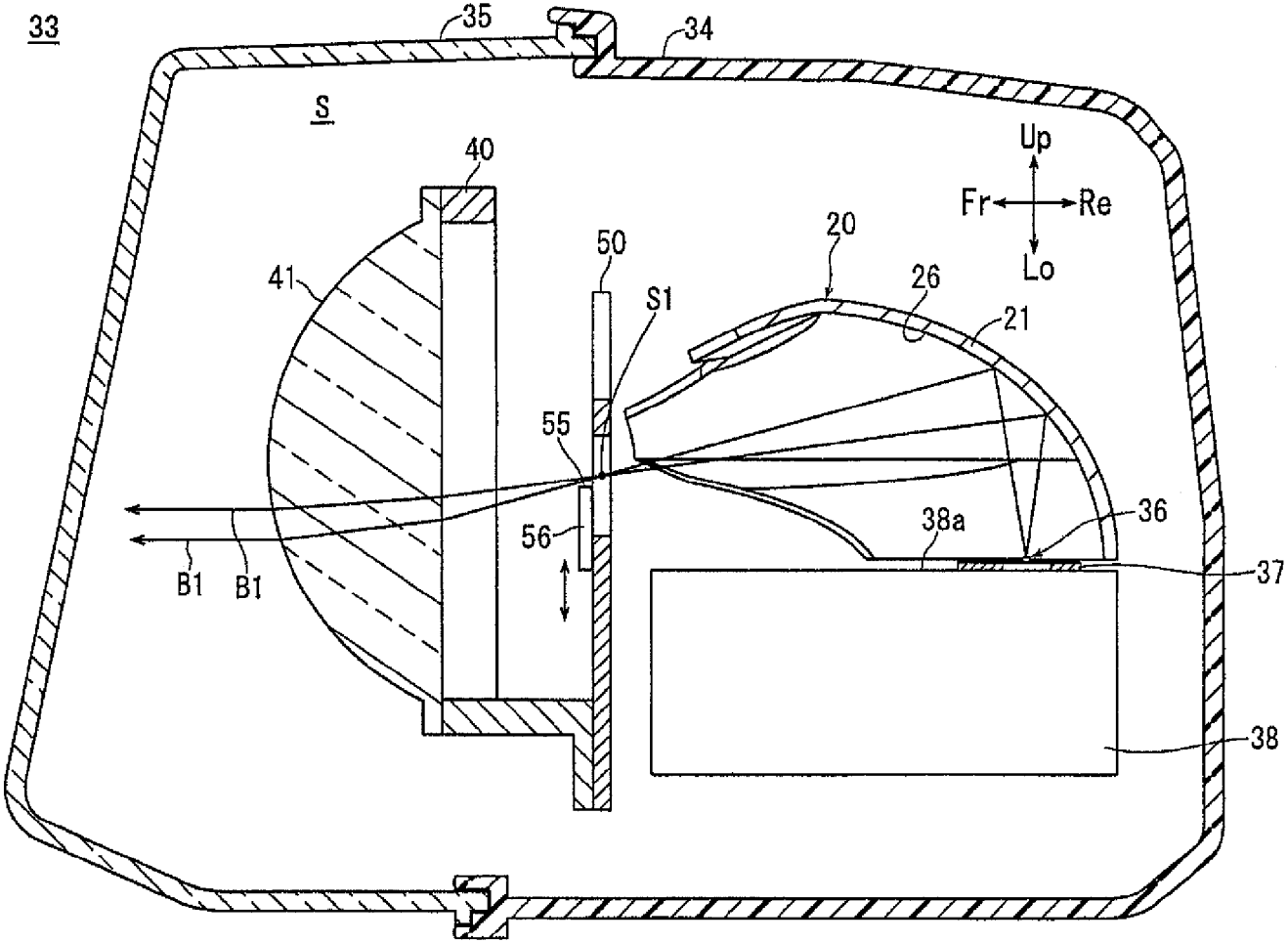
FIG. 4 is an explanatory view for explaining a ray of light in the projector type vehicular headlamp shown in FIG. 3.

Next, a projector type vehicular headlamp 33 including the reflector 20 of the second embodiment will be described with reference to FIG. 3 and FIG. 4. The vehicular headlamp 33 includes the reflector 20, the LED (Light Emitting Element) 36, a power feeding attachment 37 for attaching the LED 36 thereon, the resin supporting member 38, a movable shade unit 39, a lens holder 40 and a projection lens 41. Further, as shown in FIG. 4, the projector type vehicular headlamp 33 is disposed in a lamp chamber S which is formed by a lamp body 34 that is opened forward and formed of resin or the like and a transparent or semi-transparent front cover 36 that closes the front of the lamp body 34. The projector type vehicular headlamp 33 is supported on the lamp body 34 by an aiming mechanism (tiling mechanism) which is not shown.

The LED 36 is fixed to the supporting member 38 via the power feeding attachment 37. The power feeding attachment 37 is fixed to the supporting member 38 in a state where a rear surface of a substrate of the LED 36 is brought into contact with an upper surface 38*a* of the supporting member 38 by fitting a pair of protrusions 38*b*, 38*c* of the upper surface 38*a* into circular holes 37*a*, 37*b* of the power feeding attachment 37. Further, at the upper surface 38*a* of the supporting member 38, a pair of reflector fixing portions 42, 43 is provided at positions corresponding to the circular holes 28, 29 in the pair of arm parts 22, 23 of the reflector 20. The reflector 20 is attached to the reflector fixing portions 42, 43 in such a way that a pair of screw members 44, 45 is inserted into the circular holes 28, 29 and screwed to female screw holes 42*a*, 43*a* provided on the inside of the reflector fixing portions 42, 43. As a result, the reflector 20 is fixed to the supporting member 38 in a state where the LED 36 is surrounded with the reflective surface 26.

The movable shade unit 39 is disposed in front of the supporting member 38. The projection lens 41 attached to the lens holder 40 is disposed in front of the movable shade unit 39. The movable shade unit 39 and the lens holder 40 are fixed to the supporting member 38 in such a way that three screw members 46*a* to 46*c* are respectively inserted into circular holes 39*a* to 39*c* provided on an end portion of the movable shade unit 39 and circular holes 40*a* to 40*c* provided on the lens holder 40 and then screwed to female screw holes 48*a*, 49*a* (and the other one is not shown) of three fixation portions 48, 49 (and the other one is not shown) provided on a front end portion of the supporting member 38.

The movable shade unit 39 includes a motor 51 attached to a supporting plate 50 with the circular holes 39*a* to 39, a gear 52 attached to a pivot shaft of the motor 51, an arm 53 which has one end pivotably attached to the supporting plate 50 and includes a gear meshed with the gear 52, a shade 56 which has one end pivotably attached to the other end of the arm 53 and includes a cutoff line forming portion 55 at an upper end thereof and, and a torsion coil spring 57.

In a case where power is not supplied to the motor 51, the shade 56 is urged to an upward positioning stopper (not shown) provided on the supporting plate 50 by the torsion coil spring 57 and the cutoff line forming portion 55 is disposed near a rear focal point S1 of the projection lens 41 while keeping a horizontal state thereof. In a case where power is supplied to the motor 51, the shade 56 shown in FIG. 3 is lowered to a position where the light emitted from the LED 36 is not shielded by the swinging of the arm 53 including the gear. The shade 56 lowered to the position where the shade does not shield the light emitted from the LED 36 is lifted by receiving an urging force of the torsion coil spring 57 when the power supply to the motor 51 is interrupted. At this time, the cutoff line forming portion 55 is returned to the vicinity of the rear focal point S1 of the projection lens 41.

As shown in FIG. 4, the light B1 emitted from the LED 36 is reflected in the reflective surface 26 so that a focal point thereof is near the rear focal point S1 of the projection lens 41. In a case where the power supply to the motor 51 is interrupted, the emitted light B1 passes through the projection lens 41 and the front cover 35 while a portion of the light is shielded by the cutoff line forming portion 55 of the shade 56, thereby forming a light distribution pattern for a lower beam in front of the vehicular headlamp 33. Meanwhile, in a case where power is supplied to the motor 51, the emitted light B1 is not shielded by the shade 56, thereby forming a light distribution pattern for a high beam in front of the vehicular headlamp 33.

Since the reflector 20 to be thermally deformed by the lighting heat of the LED 36 is thermally deformed while keeping a similar shape thereto owing to the contraction of the wave-shaped portions 24, 25 serving as the thermal deformation absorbing portion, a light distribution pattern without a deformation is formed in front of the vehicular headlamp 33.

Next, a reflector of a third embodiment having a shade integrally provided therewith will be described with reference to FIG. 5. A reflector 60 of the third embodiment is obtained by forming a shade 61 in the reflector 20 of the second embodiment, instead of providing a movable shade unit 39 shown in FIG. 4. The shade 61 and the reflector body 21' form the reflector 60 that is an optical member. The shade 61 has a plate-like shape and is formed integrally to an inner side of the reflector body 21'. Further, the shade 61 is formed to extend rearward along a lower end portion 21*b*' from front end portions 21*c*', 21*d*' of the reflector body 21'. A stepped cutoff line forming portion 62 is provided on an upper end of a front end portion 61*a* of the shade 61. The cutoff line forming portion 62 is disposed near a rear focal point of a projection lens (not shown). In addition, the reflector 60 of the third embodiment may be formed in such a way that the shade 61 and the reflector body 21' are separately formed and then the shade 61 is bonded to the reflector body 21' by a bonding means such as adhesion or thermal caulking.

A reflective surface 63 is provided on an upper surface of the shade 61 by silver deposition or the like. Further, the shade 61 is respectively provided with a pair of gap portions 64, 65 serving as a thermal deformation absorbing portion. The pair of gap portions 64, 65 is formed on the shade 61 to extend rearward along a curved shape of the reflective surface 26' from the front end portion 61*a*, in the vicinity of both left and right end portions 61*c*, 61*d* of the shade 61.

Figure 5:
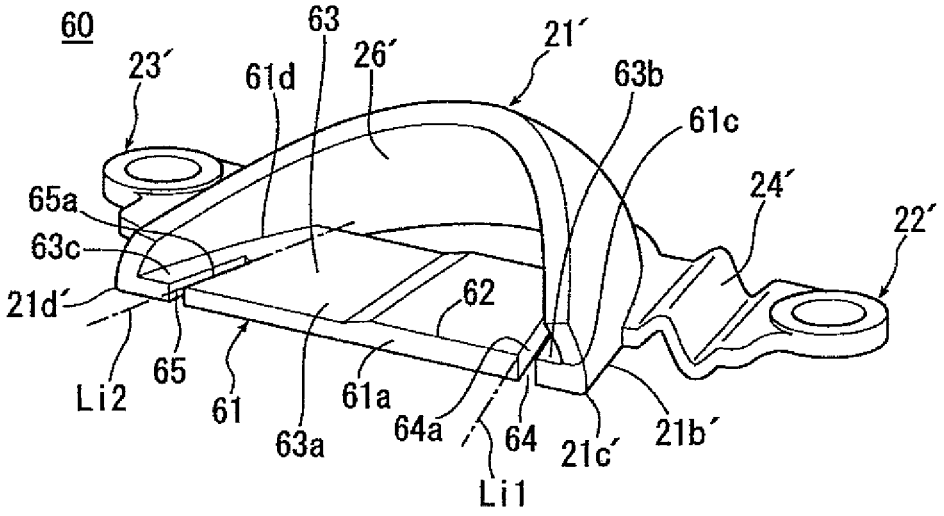
FIG. 5 is a perspective view of a reflector according to a third embodiment, which is integrally provided with a shade.

As shown in FIG. 5, the reflective surface 63 of the shade 61 includes a reflective region 63*a* that is used for reflection of light and non-reflective regions 63*b*, 63*c* that are not used for reflection of light. The reflective region 63*a* is formed at a portion of the reflective surface 63 between an extending line Li1 passing through an inner edge 64*a* of the gap portion 64 and an extending line Li2 passing through an inner edge 65*a* of the gap portion 65. Further, the non-reflective region 63*b* is formed on the outside of the extending line Li1 and the non-reflective region 63*c* is formed on the outside of the extending line Li2. Since the pair of gap portions 64, 65 is respectively formed in the non-reflective regions 63*b*, 63*c* of the reflective surface 63, the reflection of light in the reflective region 63*a* is not hindered and the deformation of a light distribution pattern does not occur.

The light that is emitted from an LED (not shown) and reflected by the reflective surface 26' is focused in the vicinity of the cutoff line forming portion 62. Therefore, the light is emitted to the front of a vehicular headlamp from a projection lens and front cover (that are not shown) while a portion of the light is shielded by the cutoff line forming portion 62. The light shielded by the cutoff line forming portion 62 is re-reflected obliquely upward by the reflective surface 63 and then emitted to the front of a vehicular headlamp from a projection lens and front cover (that are not shown). The thermal deformation of the shade 61 of the reflector 60 is promoted freely in a lateral direction by the presence of the gap portions 64, 65 of the shade 61 and each contraction of a wave-shaped portion 24' of an arm part 22' and a wave-shaped portion (not shown) of an arm part 23'. As a result, since the reflective surface 26' of the reflector body 21' and the shade 61 are thermally deformed while keeping a similar shape thereto, it is possible to form a light distribution pattern without a deformation.

Next, a reflector of a fourth embodiment in which a reflector body serves as a shade will be described with reference to FIG. 6. A reflector 70 of the fourth embodiment that is an optical member includes a plate-shape reflector body 71 formed to extend forward and backward and a pair of arm parts 72, 73 formed to extend laterally from a rear end portion 71 a of the reflector body 71. The arm parts 72, 73 are provided with circular holes 74, 75 as a fixation portion (not shown) for the supporting member. The circular holes 74, 75 are penetrated in a vertical direction.

A pair of gap portions 76, 77 serving as a thermal deformation absorbing portion is formed in the reflector body 71 (or arm parts 72, 73) in between the circular holes 74, 75. The gap portions 76, 77 are formed in the reflector body 71 or the arm parts 72, 73 to extend forward from the rear end portion 71*a* (or rear end portions 72*a*, 73*a* of the arm parts 72, 73) of the reflector body 71.

A reflective surface 78 is formed on an upper surface of the reflector body 71 by silver deposition or the like. In addition, a stepped cutoff line forming portion 79 is formed on an upper end of a front end portion 71*b* of the reflector body 71 so as to be disposed near a rear focal point of a projection lens (not shown). As a result, the reflector body 71 also has a function as a shade.

Figure 6:
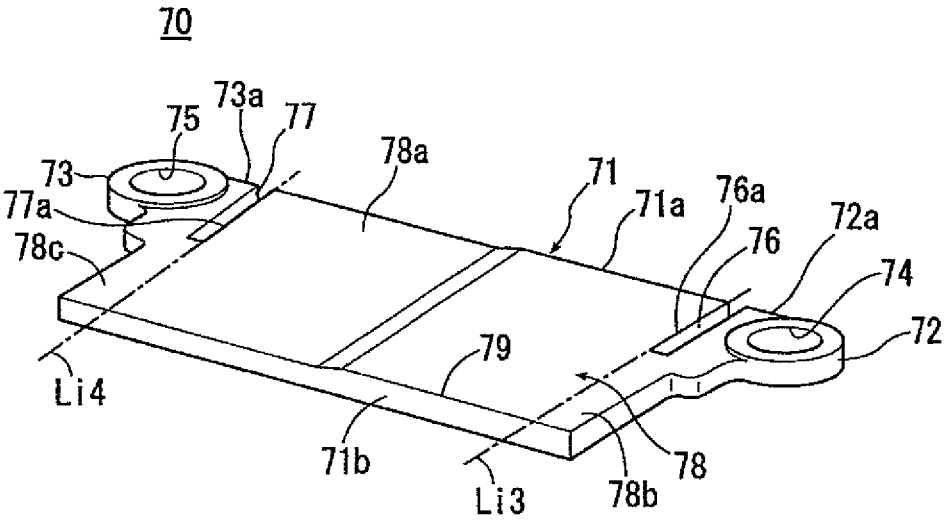
FIG. 6 is a perspective view of a reflector according to a fourth embodiment, in which a reflector body serves as a shade.
Figure 7A:
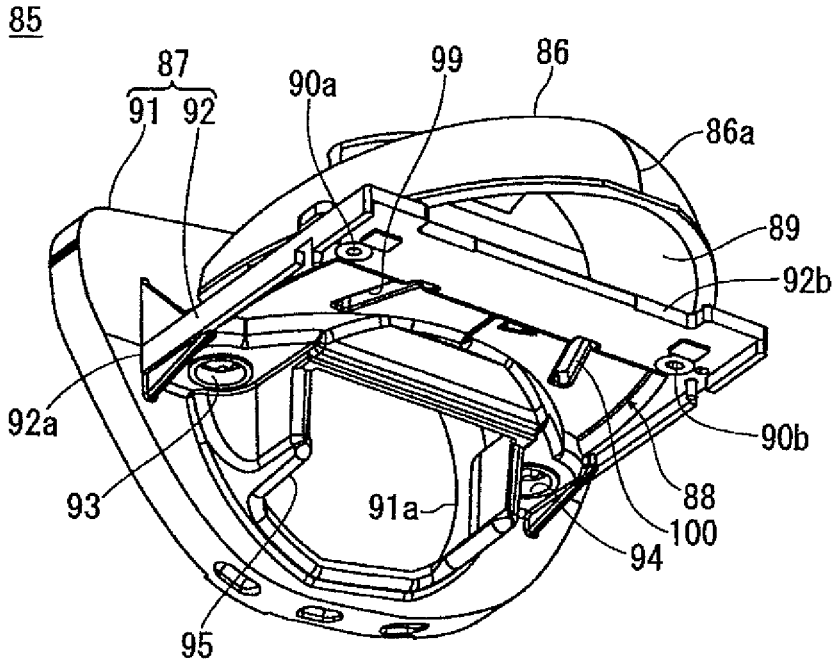
FIG. 7A is a perspective view of an optical member according to a fifth embodiment, which includes a lens holder with a shade and a reflector.
Figure 7B:
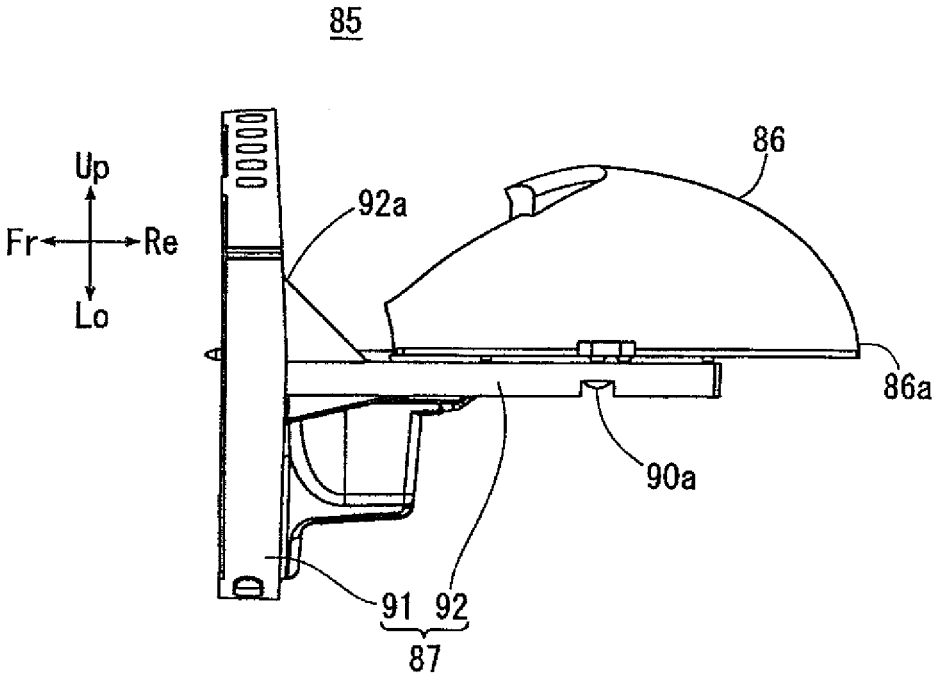
FIG. 7B is a left side view of the optical member according to the fifth embodiment.

As shown in FIG. 6, the reflective surface 78 of the reflector body 71 includes a reflective region 78*a* that is used for reflection of light and non-reflective regions 78*b*, 78*c* that are not used for reflection of light. The reflective region 78*a* is formed between an extending line Li3 passing through an inner end 76*a* of the gap portion 76 and an extending line Li4 passing through an inner end 77*a* of the gap portion 77. The non-reflective region 78*b* is formed on the outside of the extending line Li3 and the non-reflective region 78*c* is formed on the outside of the extending line Li4. Since the pair of gap portions 76, 77 is respectively formed in the non-reflective regions 78*b*, 78*c* of the reflective surface 78, the reflection of light in the reflective region 78*a* is not hindered and the deformation of a light distribution pattern does not occur.

The light emitted from an LED (not shown) is emitted to the front of a vehicular headlamp from a projection lens and front cover (that are not shown) while a portion of the light is shielded by the cutoff line forming portion 79. The light shielded by the cutoff line forming portion 79 is re-reflected obliquely upward by the reflective surface 78 and then emitted to the front of a vehicular headlamp from a projection lens and front cover (that are not shown). Since the thermal deformation of the reflective surface 78 and the cutoff line forming portion 79 in the reflector body 71 is promoted freely in a lateral direction as well as in an upper direction by the gap portions 76, 77, the reflective surface 78 and the cutoff line forming portion 79 are thermally deformed while keeping a similar shape thereto. As a result, it is possible to form a light distribution pattern without a deformation.

Although the arm part and the fixation portion are respectively provided in pairs in the reflectors of the first to fourth embodiments, the arm part and the fixation portion may be provided by only one or the arm part and the fixation part may be provided by three or more.

Next, an optical member 85 of a fifth embodiment including a lens holder with a shade and a reflector will be described with reference to FIG. 7A to FIG. 8B.

In FIG. 7A to FIG. 9, a longitudinal direction of the optical member 85 is referred to as "a front-rear direction (a direction of the reference numeral Fr and Re)", a width direction of the optical member 85 is referred to as "a left-right direction (a direction of the reference numeral Le and Ri)" and a height direction of the optical member 85 is referred to as "an up-down direction (a direction of the reference numeral Up and Lo)".

The optical member 85 of the fifth embodiment includes a reflector 86 made of resin and a lens holder 87 having a shade 88. The reflector 86 is formed into a U shape, as seen from the upper surface and provided at its inner side with a reflective surface 89 configured by a portion of the paraboloid of revolution. The reflector 86 is fixed to the lens holder 87.

The lens holder 87 includes a lens holding part 91 and a reflector holding part 92. The lens holding part 91 is provided continuously to a front end portion 92*a* of the reflector holding part 92. The lens holding part 91 is provided at its center with an attachment hole 91*a* to which a projection lens (not shown) of a semi-spherical shape is attached.

The reflector holding part 92 includes a pair of circular holes 93, 94 that is a fixation portion provided near the front end portion 92*a* thereof, a pair of circular holes (not shown) for thermal caulking that is provided near a rear end portion 92*b* thereof and a light passing portion 95 for passing the reflected light therethrough. The circular holes 93, 94 are penetrated in a vertical direction and the light passing portion 95 is provided on the inside of the pair of circular holes 93, 94. A pair of protrusions (not shown) provided in the reflector 86 is inserted into the pair of circular holes (not shown) for thermal caulking. A leading end of the pair of protrusions is crushed by application of heat and therefore formed as thermal caulking portions 90*a*, 90*b*. The reflector 86 is fixed to the lens holder 87 by the thermal caulking portions 90*a*, 90*b*.

The shade 88 is provided between a region having the circular holes 93, 94 formed thereon and the thermal caulking portions 90*a*, 90*b*, in the reflector holding part 92. The shade 88 includes a shade body 97, a cutoff line forming portion 98 and a pair of gap portions 99, 100 that is a thermal deformation absorbing portion. The shade body 97 has a reflective surface (a rear surface of the shade body 97 in FIG. 8 B) facing the reflective surface 89 of the reflector 86. The cutoff line forming portion 98 is provided in a front end portion of the shade body 97 and has a shape similar to an arc that is concave from the front to the rear. The cutoff line forming portion 98 is disposed near a rear focal point of a projection lens (not shown) that is attached to the lens holding part 91.

Figure 8A:
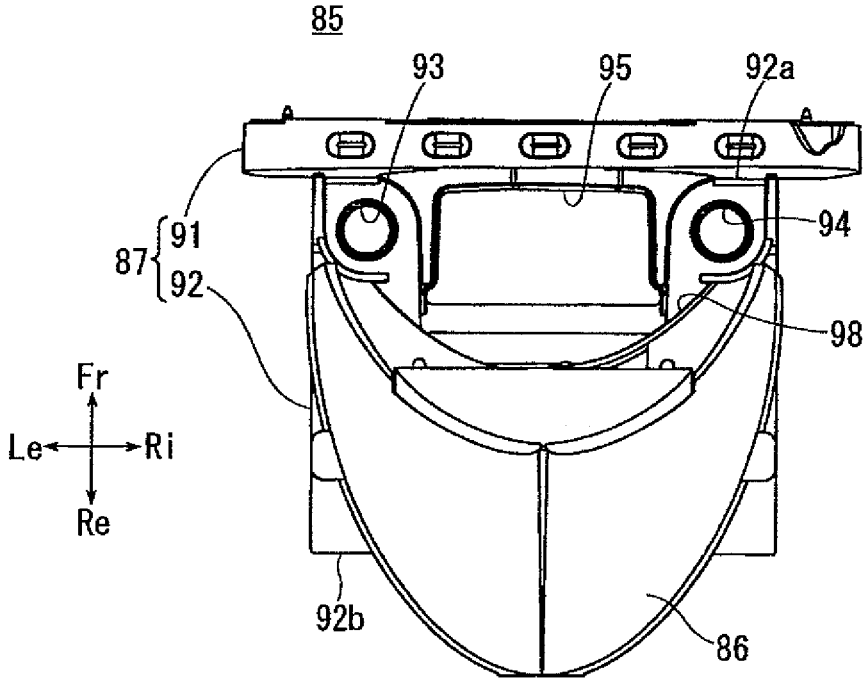
FIG. 8A is a plan view of the optical member according to the fifth embodiment.
Figure 8B:
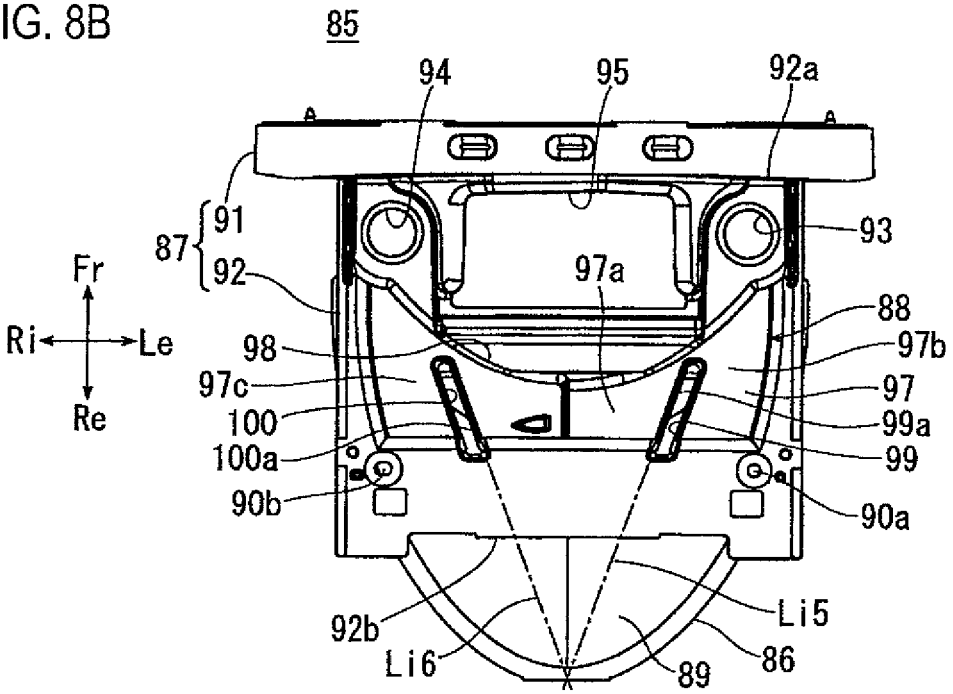
FIG. 8B is a bottom view of the optical member according to the fifth embodiment.

The pair of gap portions 99, 100 serving as the thermal deformation absorbing portion is provided in the shade body 97. In FIG. 8 B, the reflective surface formed on a rear surface of the shade body 97 includes a reflective region 97*a* that is used for reflection of light and non-reflective regions 97*b*, 97*c* that are not used for reflection of light. The reflective region 97*a* is formed between an extending line Li5 passing through an inner end 99*a* of the gap portion 99 and an extending line Li6 passing through an inner end 100*a* of the gap portion 100. The non-reflective region 97*b* is formed on the outside of the extending line Li5 and the non-reflective region 97*c* is formed on the outside of the extending line Li6. The gap portion 99 is formed on the non-reflective region 97*b* located between the reflective region 97*a* and an end of the circular hole 93 serving as a fixation portion. The gap portion 100 is formed in the non-reflective region 97*c* located between the reflective region 97*a* and the circular hole 94.

Light from an LED light source (not shown) is reflected toward the shade 88 by the reflective surface 89 of the reflector 86. A portion of the reflected light is incident on the projection lens in front through the light passing portion 95 from the cutoff line forming portion 98 and the other portion of the reflected light is incident on the projection lens by being re-reflected forward by the reflective region 97*a* of the shade body 97. The light incident on the projection lens is emitted forward of the projection lens and forms a light distribution pattern based on the shape of the cutoff line forming portion 98.

The reflector 86 fixed to the supporting member is deformed by receiving heat from an LED light source at the time of lighting of the LED light source (not shown) similarly fixed to the supporting member. However, since the shade body 97 and the reflective region 97*a* are deformed while keeping a similar shape thereto by allowing the gap portions 99, 100 provided on the outside of the reflective region 97*a* to absorb deformation, the deformation of a light distribution pattern does not occur. Further, since the gap portions 99, 100 are formed in the non-reflective regions 97*b*, 97*c* on the inside between the circular holes 93, 94, the gap portions does not hinder the re-reflection of the reflected light by the shade body 97. That is, the reflected light by the reflector is not lost through the circular holes 93, 94.

The gap portions and the wave-shaped portions (thermal deformation absorbing portions) in the first to fifth embodiments may be formed at arbitrary positions of a non-reflective region that exists between the fixation portion and the reflective region.

Next, a sixth embodiment regarding a lamp unit 104 that is formed by fixing the optical member 85 to a metallic supporting member 105 will be described with reference to FIG. 9.

The lamp unit 104 includes the optical member 85 having the reflector 86 and the metallic supporting member 105 on which both a light emitting element serving as a light source and the optical member 85 are held. The reflector 86 is formed of resin and has a reflective region. A plurality of radiation fins 109 extending in a direction away from the reflector 86 is provided in the supporting member 105 so as to be arranged beside the reflector 86.

A specific configuration of the lamp unit 104 is as follows. The supporting member 105 includes a holding part 106 for the optical member 85, a pair of attachment parts 107, 108 formed to extend laterally from the holding part 106 and a plurality of radiation fins 109 formed to extend rearward of the holding part.

At an upper portion 106*a* of the holding part 106, fixation holes (not shown) are provided at positions corresponding to the circular holes 93, 94 serving as a fixation portion of the optical member 85 and the reflector holding part 92 of the optical member 85 is mounted thereon. The optical member 85 is fixed to the upper portion 106*a* of the holding part 106 in such a way that fastening members (not shown) such as bolts are inserted through the circular holes 93, 94 and the fixation holes of the holding part 106 side and mounted to female screw holes provided on holes (not shown) of the holding part 106. The lamp unit is fixed to a lamp body (not shown) or the like by the fastening of fastening members such as bolts through a plurality of circular holes 107*a* (a circular hole of the attachment part 108 is not shown) of the attachment parts 107, 108.

Figure 9:
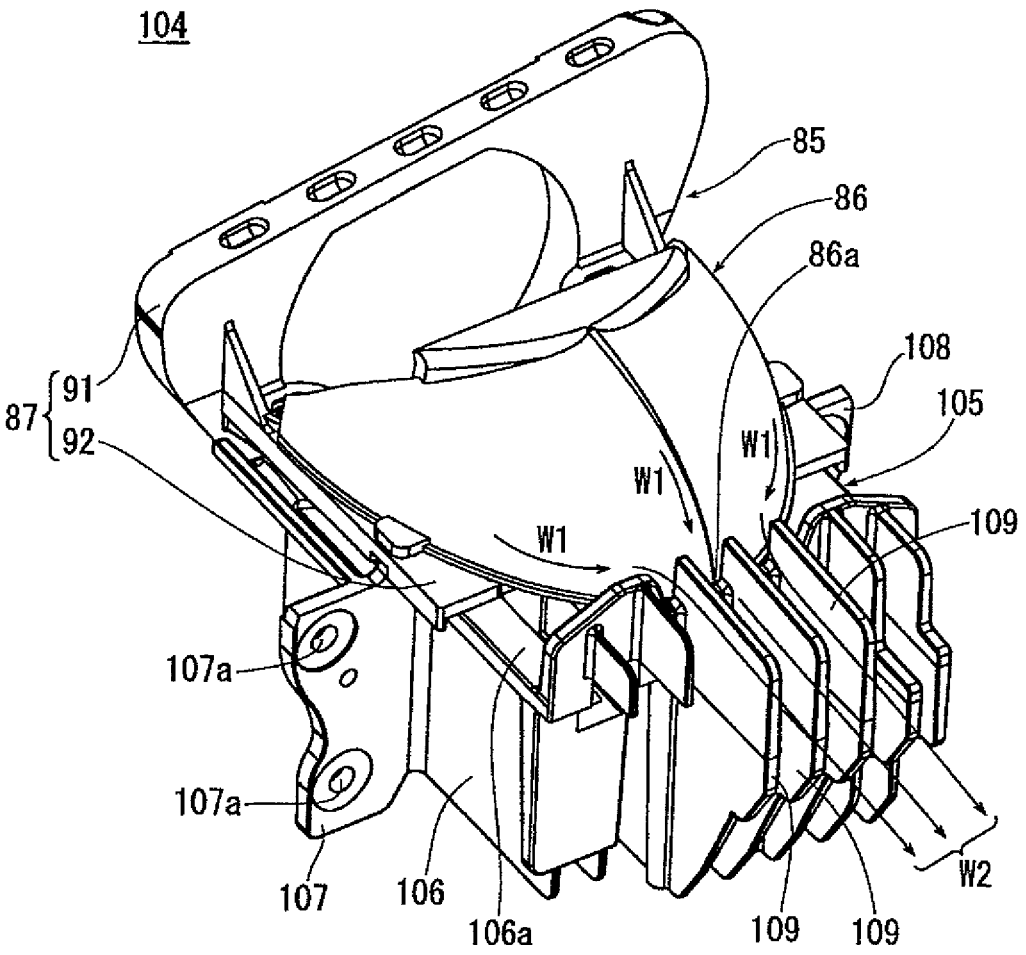
FIG. 9 is a perspective view showing a sixth embodiment, in which a lamp unit is formed by fixing the optical member according to the fifth embodiment to a supporting member.

In FIG. 9, the plurality of radiation fins 109 has a flat plate shape, respectively and extends rearward of the holding part 106. The plurality of flat plate-shaped radiation fins 109 is extended further upward from the rear of the holding part 106 and arranged beside the reflector 86, respectively. The plurality of flat plate-shaped radiation fins 109 is arranged to be parallel to each other.

A portion of heat generated at the time of lighting of the light emitting element in the lamp unit 104 is discharged from the radiation fins 109 of the metallic supporting member 105 or transmitted to the reflector 86 to raise the temperature of the reflector 86. The plurality of radiation fins 109 has a function to pass the air (whose temperature is raised in conjunction with the temperature of the reflector 86) around the reflector 86 through between adjacent radiation fins 109, thereby causing the air to flow in a direction away from the reflector 86. Further, the plurality of radiation fins 109 has an effect of reducing the thermal deformation of the reflector 86 due to the temperature rise, since hot air is not stayed around the reflector 86 owing to the radiation fins.

Specifically, as shown in FIG. 9, air warmed near an outer peripheral surface of the reflector 86 flows toward the radiation fins 109 on the rear side along the outer peripheral surface of the reflector 86 (see a reference numeral W1). Then, the air passes through the plurality of radiation fins 109 without staying in the vicinity of a rear end portion 86*a* of the reflector 86 and then is discharged further rearward of the radiation fins 109 (see a reference numeral W2).

In addition, although a plurality of flat plate-shaped radiation fins 109 shown in FIG. 9 is formed to extend rearward of the reflector, the flat plate-shaped radiation fins 109 may be formed to extend laterally or obliquely rearward from the reflector, as long as the flat plate-shaped radiation fins are composed of a plurality of plate-shaped parts extending in a direction away from the reflector 86.

What is claimed is:

1. An optical member formed of resin, comprising a fixation portion, via which the optical member is fixed to a supporting member on which a light emitting element is supported;

a reflective surface having a reflective region configured to reflect light from the light emitting element; and a thermal deformation absorbing portion configured to absorb thermal deformation of the optical member, wherein the thermal deformation absorbing portion is provided between the reflective region and the fixation portion, wherein the thermal deformation absorbing portion is a gap portion formed between the reflective surface and the fixation portion, wherein the optical member further comprises:

a reflector body including the reflective surface, and an arm part formed to extend from the reflector body, wherein the fixation portion and the thermal deformation absorbing portion are provided in the arm part, wherein the reflector body is thermally deformed toward the fixation portion for the supporting member by narrowing clearance of the gap portion when the reflector body receives heat of the light emitting element from the supporting member and therefore is thermally deformed, and wherein the gap portion is formed along a boundary of the reflector body and the arm part from one end of the arm part.

2. The optical member according to claim 1, further comprising:

a shade arranged near a focal point of the reflective region and configured to shield a portion of light reflected by reflective region.

3. The optical member according to claim 2, wherein the shade includes a thermal deformation absorbing portion different from the thermal deformation absorbing portion of the arm part.

4. The optical member according to claim 3, wherein the shade includes a reflective region configured to reflect the light reflected from the reflective region of the reflector body, and in the shade, the thermal deformation absorbing portion is provided at a region other than the reflective region.

5. A vehicular lamp comprising:

a light emitting element;

the optical member described in claim 1; and a supporting member on which the light emitting element and the optical member are supported, wherein the light emitting element, the optical member and the supporting member are provided in a lamp chamber formed by a front cover and a lamp body.

6. The optical member according to claim 1, wherein the thermal deformation absorption portion is configured such that the width thereof in the lateral direction narrows upon thermal deformation of the optical member.

7. The optical member according to claim 1, wherein the reflector body is laterally thermally deformed toward the fixation portion for the supporting member by laterally narrowing the clearance of the gap portion when the reflector body receives heat of the light emitting element from the supporting member and therefore is thermally deformed.

8. The optical member according to claim 1, wherein the reflective surface, the fixation portion, and the thermal deformation absorbing portion are disposed linearly in a lateral direction of the optical member.

* * * * *